US005692344A

United States Patent [19]

Zarth

[11] Patent Number: 5,692,344

[45] Date of Patent: Dec. 2, 1997

[54] COLUMBARIUM

[76] Inventor: Rudolf Zarth, Mainzer Strasse 41, D-66121 Saarbrücken, Germany

[21] Appl. No.: 509,031

[22] Filed: Jul. 28, 1995

[30] Foreign Application Priority Data

Aug. 4, 1994 [DE] Germany ..... 44 27 610.9

[51] Int. Cl.[6] ..... E04H 13/00

[52] U.S. Cl. ..... 52/137; 27/1

[58] Field of Search ..... 52/169.6, 136, 52/137, 128; 27/1, 26, 28, 29, 30

[56] References Cited

U.S. PATENT DOCUMENTS

| | | | |
|---|---|---|---|
| 980,750 | 1/1911 | Blyth . | |
| 3,754,805 | 8/1973 | Pangum et al. | 52/136 X |
| 3,878,656 | 4/1975 | Duwe et al. | 52/136 X |
| 3,925,944 | 12/1975 | Pickel | 52/136 X |
| 3,990,198 | 11/1976 | Ortutay | 52/136 |
| 4,023,316 | 5/1977 | Martin | 52/137 X |
| 4,231,201 | 11/1980 | Harnois | 52/169.6 |
| 4,989,382 | 2/1991 | Seroken | 52/136 X |
| 5,195,812 | 3/1993 | Eickhof | 52/136 X |
| 5,287,603 | 2/1994 | Schorman | 27/1 |

FOREIGN PATENT DOCUMENTS

| | | | |
|---|---|---|---|
| 92978 | 11/1983 | European Pat. Off. | 52/128 |
| 2361922 | 6/1975 | Germany . | |
| 2517805 | 11/1975 | Germany . | |

*Primary Examiner*—Carl D. Friedman
*Assistant Examiner*—Yvonne Horton-Richardson
*Attorney, Agent, or Firm*—Friedrich Kueffner

[57] ABSTRACT

A columbarium in the form of a structure includes a plurality of components forming urn chambers for receiving at least one urn. The front opening of each component is closed by a door. The components are arranged in horizontal rows with the side walls of the components being located next to one another. At least two rows of components are arranged on top of each other. The structure has an interior for forming a common chamber for abandoned urns which are to be pushed through the rear opening of each component.

6 Claims, 3 Drawing Sheets

COLUMBARIUM

BACKGROUND OF THE INVENTION

1. Field of the Invention

The invention relates to a columbarium in the form of a structure having rows of urn chambers arranged next to one another, wherein the rows are arranged one above the other.

2. Description of the Related Art

Such columbaria are known from other cultures, for example, in the form of high urn walls with projecting passages which are arranged one above the other.

In the Western European area, urns are essentially placed in the manner of coffins in earth burial places. As a rule, there is room for four urns in horizontal rows one behind the other.

In accordance with regulations, the time of stay of the urns in the columbarium is at least 20 years. After this period of time, the urns composed of a transient material are decayed; the columbarium can be occupied once again. The regulations apply independently of whether dependents are still living and whether there is still interest in the columbarium or whether it has been completely abandoned.

SUMMARY OF THE INVENTION

In accordance with the invention, it is provided for this purpose that the urn chambers are open toward the interior of the structure and the structure has in the interior thereof a common chamber for abandoned urns.

This makes it possible to occupy an urn chamber with an additional urn as desired or to abandon and reassign the urn chamber. The most rearward urn or urns are pushed toward the rear out of the urn chamber and are transferred into the common chamber as a result. This common chamber is also part of the columbarium and meets the requirement that a columbarium must be maintained for 20 years.

While otherwise those columbaria in which is there is no longer any interest also occupy the full space up to the expiration of the twentieth year, it is now possible to utilize a reduced space requirement.

BRIEF DESCRIPTION OF THE DRAWING

The drawings illustrate an embodiment of the invention.

DESCRIPTION OF THE PREFERRED EMBODIMENTS

Figure 1:
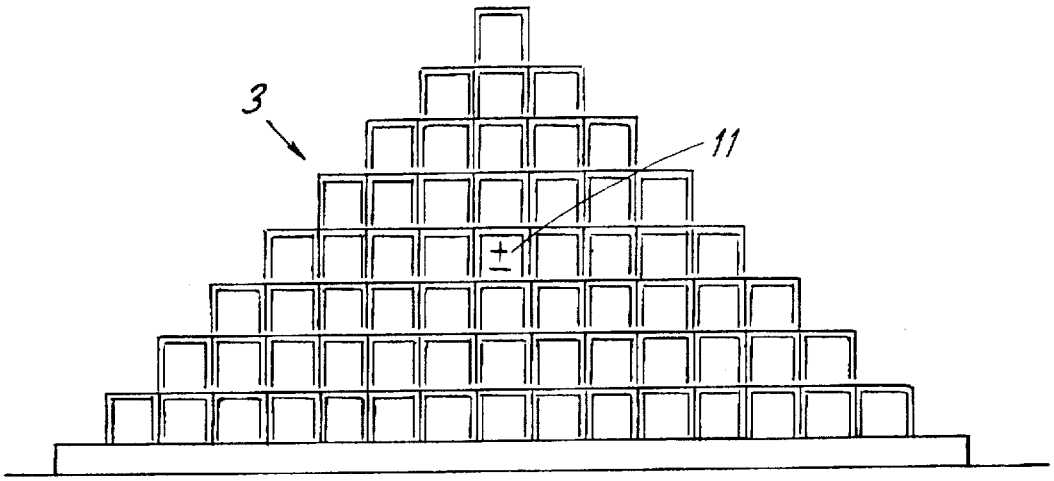
FIG. 1 shows a columbarium in an elevational view.
Figure 2:
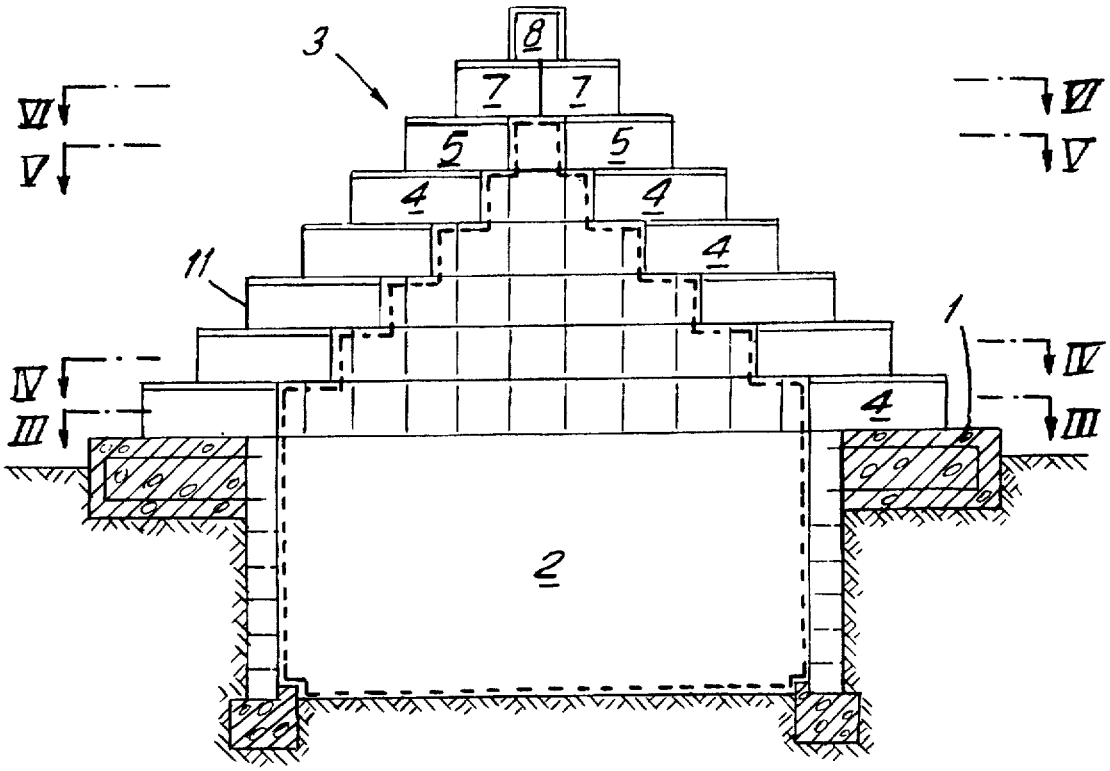
FIG. 2 shows the columbarium in a vertical center sectional view.

An annular, square concrete foundation 1 surrounds on the level of the soil surface the upper end of an earth chamber 2. The sides of the earth chamber 2 are provided with walls and the bottom of the earth chamber 2 is natural soil. The concrete foundation 1 projects slightly above the level of the earth surface.

A stepped pyramid 3 is erected in eight layers on the concrete foundation 1.

The pyramid 3 is composed of concrete elements 4–9 which form a kit. A variation 10 is illustrated at the top left of FIG. 3.

The concrete elements 4–7 have a U-shaped cross section. They are 40 cm wide and 40 cm high and have a wall thickness of 5 cm.

The basic elements are the concrete elements 4 having a length of 100 cm, wherein the four side walls of the pyramid 3 are constructed of concrete elements 4 to the extent possible. In the corner areas, the concrete elements 5 having a length of 80 cm and the concrete elements 6 having a length 40 cm are used. The concrete elements 7 having a length of 60 cm occur only in the layer which is the second to the top (FIG. 6).

The concrete element 8 is cube-shaped and has an open bottom side. The concrete element 8 again has an edge length of 40 cm and a wall thickness of 5 cm. This concrete element forms the uppermost layer.

The concrete elements 9 are cube-shaped and have an open bottom side and two adjacent open sides. The concrete elements 9 again have an edge length of 40 cm and a wall thickness of 5 cm. The concrete elements 9 are used entirely at the corners of the pyramid. Each variation 10 comprises concrete elements 5, 6 and 9, wherein the wall thickness is partially increased.

Figure 3:
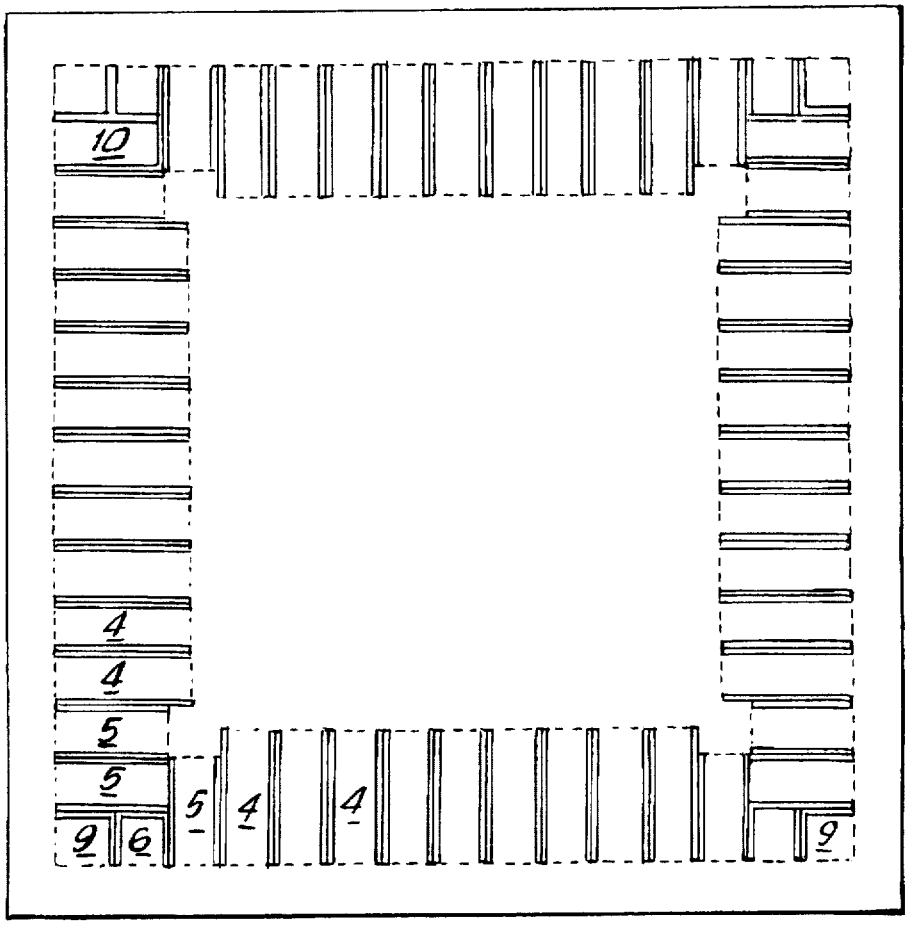
FIGS. 3–6 show the columbarium in horizontal sectional views taken along lines III—III, IV—IV, V—V and VI—VI, respectively, in FIG. 2.
Figure 4:
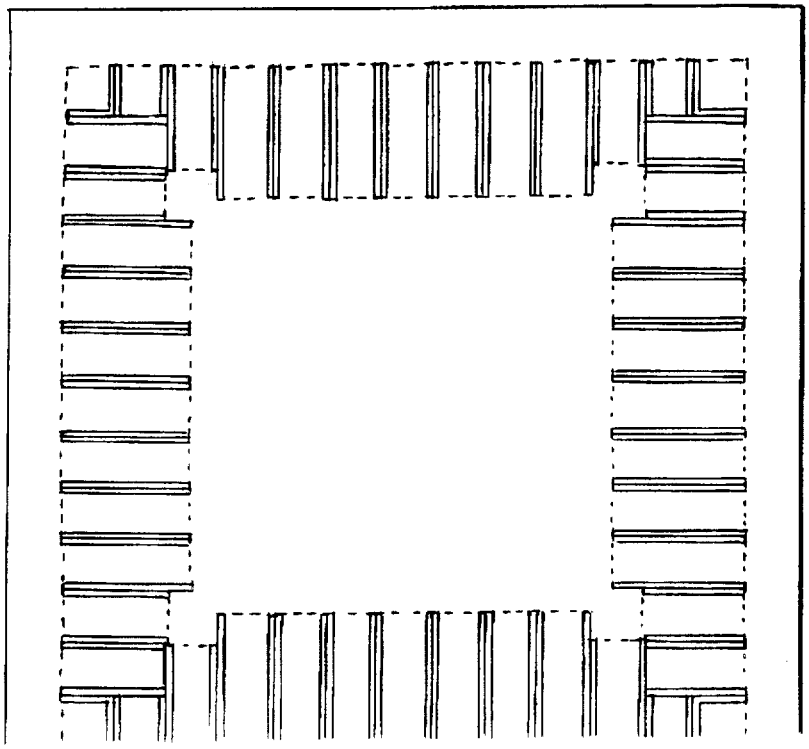
Figure 5:
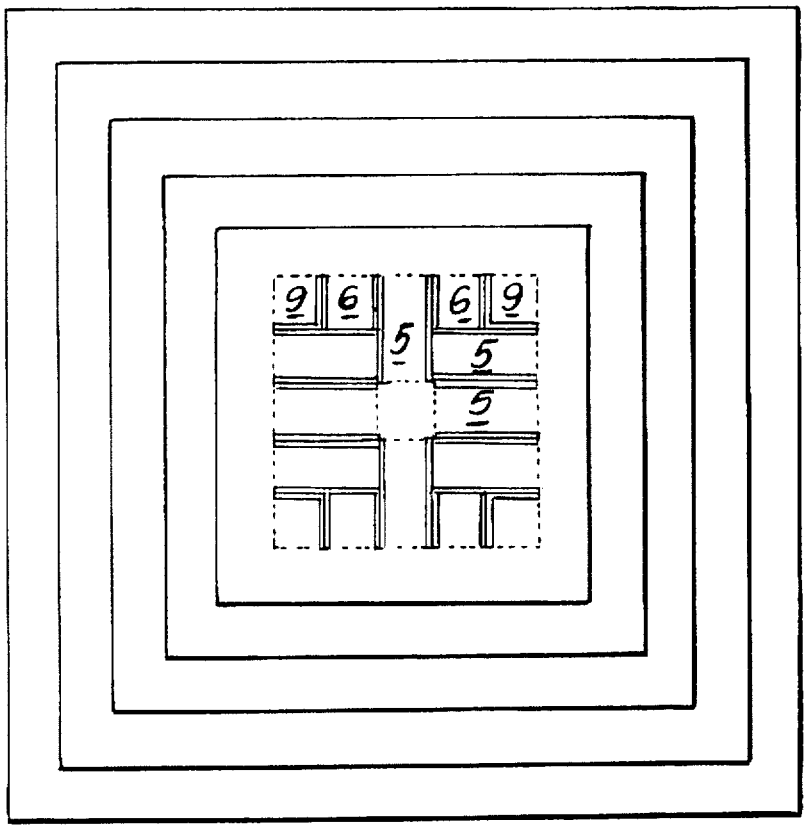
Figure 6:
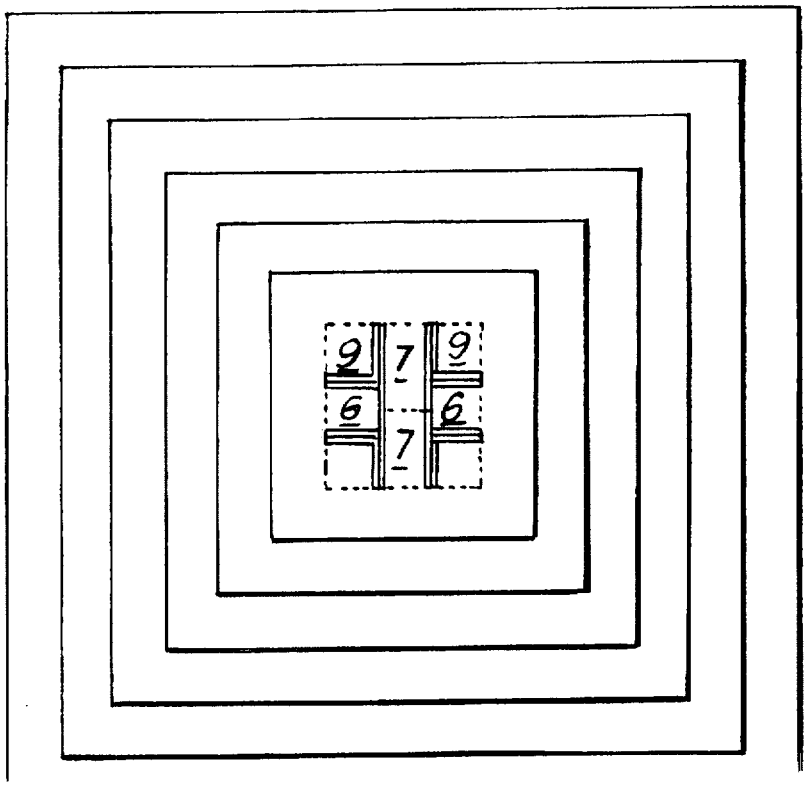

FIG. 3 shows the first layer of the concrete elements, FIG. 4 shows the second layer, FIG. 5 shows the sixth layer and FIG. 6 shows the seventh layer.

The concrete elements 4–6 are placed so that the open sides of the U-shaped cross sections are at the bottom, while the open sides of the concrete elements 9 face downwardly and outwardly. Arranged adjacent to the concrete elements 9 is on one side a concrete element 6 and on the other side a concrete element 5. Next arranged on both sides are once again concrete elements 5 which are followed by the concrete elements 4. In the sixth layer, no concrete element 4 is provided; see FIG. 5. The seventh layer has a special configuration, as can be seen in FIG. 6.

By reducing the number of concrete elements 4 by two from layer to layer, a step having a width of 40 cm is created in each case.

To the extent that they are not abutting each other in the corner areas, the urn chambers formed by the concrete elements 4–9, also the variation 10, are open toward the interior of the pyramid.

To the outside, the urn chambers are closed by heavy doors 11 which are inscribed and possibly decorated in the manner of grave stones.

The concrete elements are preferably composed of suitably dyed and/or decorative concrete.

Up to four urns can be placed in the urn chambers of the concrete elements 4 of the first layer. In the other layers, there is room for two urns each.

In the urn chambers which are open toward the interior of the pyramid, the urns can be pushed ahead until they fall out. As a result, they are transferred into the earth chamber 2 forming a common chamber, as indicated by a broken line.

I claim:

1. A columbarium in the form of a structure having an interior, at least a portion of the structure comprising a plurality of components forming urn chambers for receiving at least one urn, each component having a front opening such that the urn chambers are accessible from outside, a rear opening which is open toward the interior and sides, the front opening of each component being closed by a door, the components being arranged in horizontal rows with the sides of the components being located next to one another, at least two rows of components being arranged on top of each other, the interior of the structure forming a common chamber abandoned urns to be pushed through the rear opening of each component into the common chamber.

2. The columbarium according to claim 1, wherein the common chamber comprises an earth chamber on a lever below the structure.

3. The columbarium according to claim 1, wherein the at least two rows comprise a lower row and an upper row placed on top of the lower row, and wherein the upper of the two rows is rearwardly offset relative to the lower of the two rows so as to form a step.

4. The columbarium according to claim 3, wherein the structure is pyramid-shaped.

5. The columbarium according to claim 1, wherein each component is a concrete element.

6. The columbarium according to claim 5, wherein each concrete element has a downwardly open U-shaped cross-section.

* * * * *